United States Patent [19]

Giacomo

[11] Patent Number: 4,598,378

[45] Date of Patent: Jul. 1, 1986

[54] MANAGEMENT INFORMATION SYSTEM AND ASSOCIATED VENDING CONTROL DEVICE

[75] Inventor: Harlan R. Giacomo, St. Louis County, Mo.

[73] Assignee: H.R. Electronics Company, St. Louis, Mo.

[21] Appl. No.: 464,718

[22] Filed: Feb. 7, 1983

[51] Int. Cl.[4] ..... G07F 11/00

[52] U.S. Cl. ..... 364/479; 221/21; 221/14; 221/129; 340/825.35; 340/825.83

[58] Field of Search ..... 364/479; 221/2, 6, 14, 221/21, 123, 125, 129; 340/825.35, 825.84, 825.83; 194/1 M, DIG. 3, 1 N; 365/105, 228, 229; 371/66, 4

[56] References Cited

U.S. PATENT DOCUMENTS

| | | | |
|---|---|---|---|
| 3,611,319 | 10/1971 | Hyatt | 365/105 |
| 3,869,032 | 3/1975 | Wheelwright et al. | 194/1 N |
| 4,188,962 | 2/1980 | Onoe et al. | 364/405 |
| 4,272,757 | 6/1981 | McLaughlin et al. | 340/825.35 X |
| 4,284,208 | 8/1981 | Levasseur | 340/825.25 |
| 4,359,147 | 11/1982 | Levasseur | 364/479 X |
| 4,366,481 | 12/1982 | Main et al. | 340/825.54 |
| 4,369,442 | 1/1983 | Werth et al. | 340/825.35 |
| 4,372,464 | 2/1983 | Otten | 221/14 |
| 4,376,479 | 3/1983 | Sugimoto et al. | 194/1 N |
| 4,422,163 | 12/1983 | Oldenkamp | 365/228 |
| 4,458,307 | 7/1984 | McAnlis | 365/229 |

*Primary Examiner*—Joseph Ruggiero
*Assistant Examiner*—Allen MacDonald
*Attorney, Agent, or Firm*—Haverstock, Garrett & Roberts

[57] ABSTRACT

The combination of a vend control circuit with a device to accumulate an ongoing history of the operation of a vending machine capable of vending products and making change, the improvements comprising circuit elements for detecting the occurence of an interruption in the supply of power from a power source to the circuit and operable to prevent loss of stored information on the ongoing machine operations before resetting the circuit, an internal source of energy rechargeable by the power source, a pricing matrix and associated switches the combined settings of which establish the vend price for the machine, and a sensor device responsive whether or not the door to the vending the machine is open for restocking or servicing including a control circuit associated with the door sensor device for distinguishing between vends made by the vending machine when the door is open and vends made by the machine when the door is closed.

23 Claims, 3 Drawing Figures

MANAGEMENT INFORMATION SYSTEM AND ASSOCIATED VENDING CONTROL DEVICE

Figure 1A:
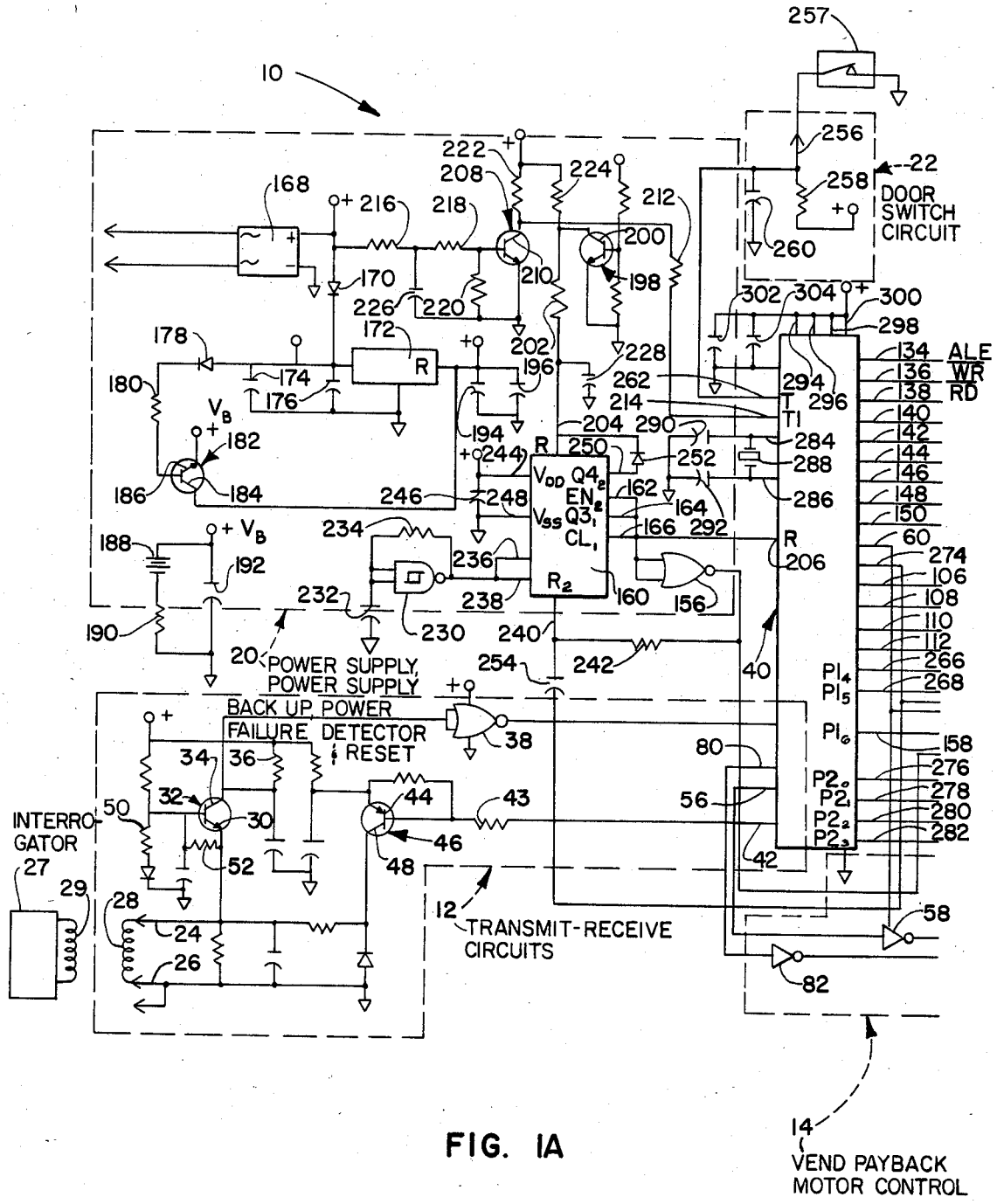

There are many control devices such as mechanical and electronic control devices for controlling the operation of vending machines and other coin operated devices and the like including devices for controlling certain operations and functions of such devices such as devices for keeping track of the monies deposited, vends made, amounts paid out in change and refunds, monies periodically removed from the cash box, machine service records and other information. Typical of devices of this general nature are the devices disclosed in U.S. Pat. No. 4,280,181. Such devices have been used with known vending control circuits including control circuits such as shown in U.S. Pat. Nos. 3,841,456 and 3,894,220 and others. The present invention has certain features and capabilities that are not found or available in any known device and which represent important advances in information gathering and in the management of information associated with the vending and related industries. Included in the novel features provided by the present construction are features which include battery backup for the management information recorded and stored by the device to prevent loss of data due to a power failure or interruption, the serial transfer of the management information records under control of a microprocessor including the transfer of information relating to price, cash accrued, number of sales, number of free vends or vends made when the vending machine door is open as, for example, when the machine is being serviced and other information. The present system also has the capability of being interrogated by external means and it may include means for monitoring a vending control door switch which in turn permits the monitoring of free vends, and the present device preferably has encoding features which are implemented with a programmed diode matrix also used in the selection of price information when needed or requested. Still further, the present device includes a coin-jam time-out feature for the paying back of change so that change operations are completed before the coin changer will again be ready to accept coins and vend products, and the present management information system can be physically embodied in the same space with the usual machine vend control circuits without requiring any additional means to interface with other circuitry in the vending machine itself. The present system can also be used to instruct and to make changes in the instructions that affect operation of the vending machine. These and other features of the present construction are unique in the management information field particularly as it relates to the vending art, and they substantially increase the amount of information that can be learned and retained about a vending machine and its operations. The present device can also be used to program the vending machine for certain purposes such as to change certain machine parameters including to change the vend price of the products being vended as well as to enable other changes. The present system therefore enables owners and/or managers of vending machines to be able to obtain more information about their machines and to audit their machines on an individual machine basis as frequently as desired, and this makes possible better and more current management of vending machines. The present system also enables owners of vending machines to achieve greater confidentiality in the operation of their machines and to better evaluate the performance and honesty of the persons who service the machines.

It is therefore a principal object of the present invention to provide owners of vending machines with more information about the operation and performance of each individual vending machine under their control.

Another object is to teach the contruction and operation of a management information system which will not lose information stored therein due to a power failure.

Another object is to increase the transfer and exchange of information about a vending machine including information relating to price, cash accrued, monies paid out as overdeposits and refunds, sales to customers and free vends, frequency of service and related matters.

Another object is to be able to monitor vends made from a vending machine when the door of a vending machine is open.

Another object is to provide a management information system for vending and like machines which provides confidentiality and increased record keeping capabilities automatically and whenever requested as by interrogating the record keeping means on the vending machine.

Another object is to provide a vending management system for vending machines which has coin-jam time-out capabilities and which operates on established time periods during which coins to be paid back must be paid back before other machine functions can be performed.

Another object is to provide improved means for storing and reading out information relating to the operation of a vending machine.

Another object is to combine in the same physical size and space presently used by vending control devices additional circuitry used to control management information functions.

Another object is to greatly enlarge the information and information gathering functions and capabilities of vending machines.

Figure 1B:
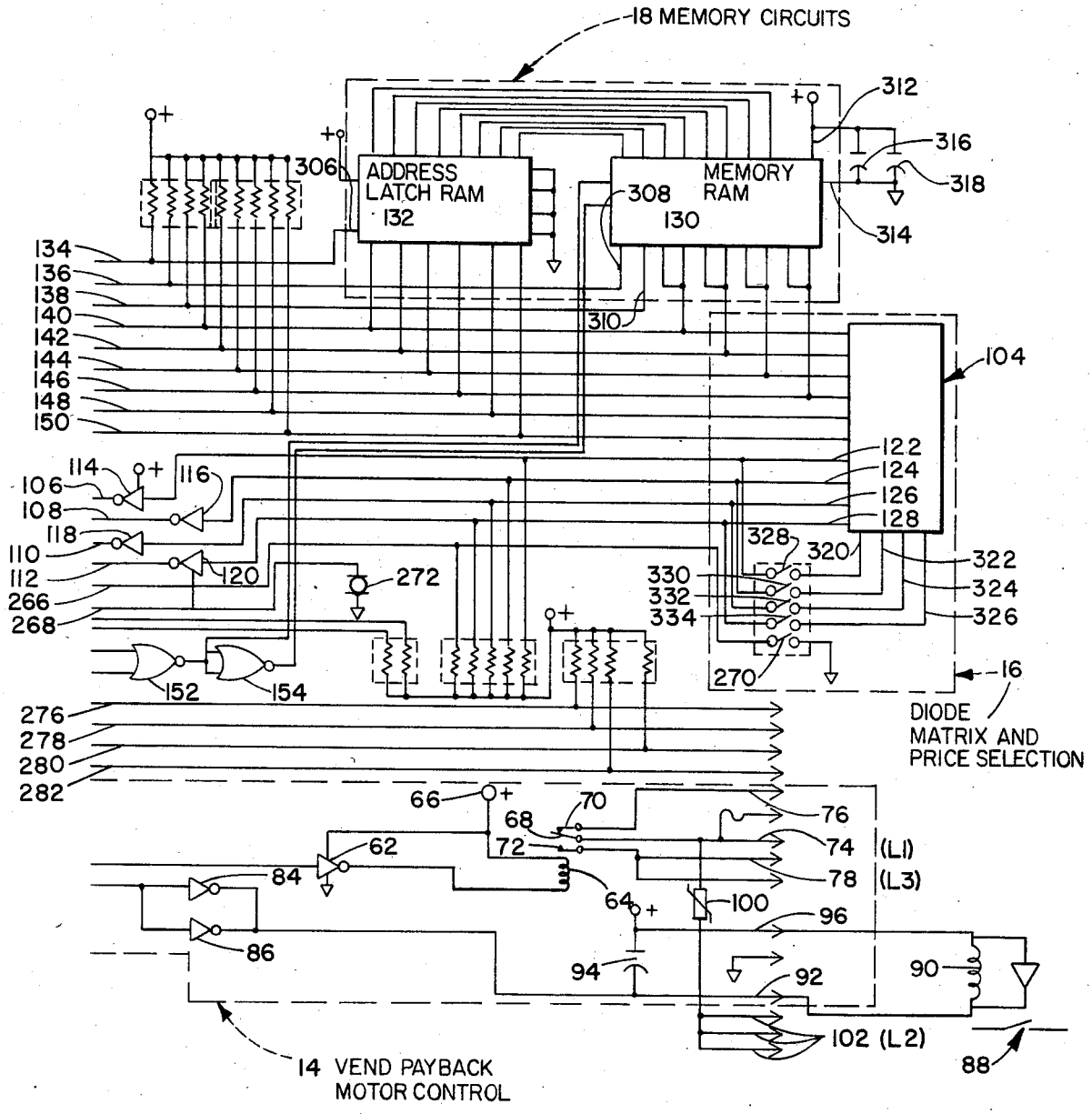
Figure 2:
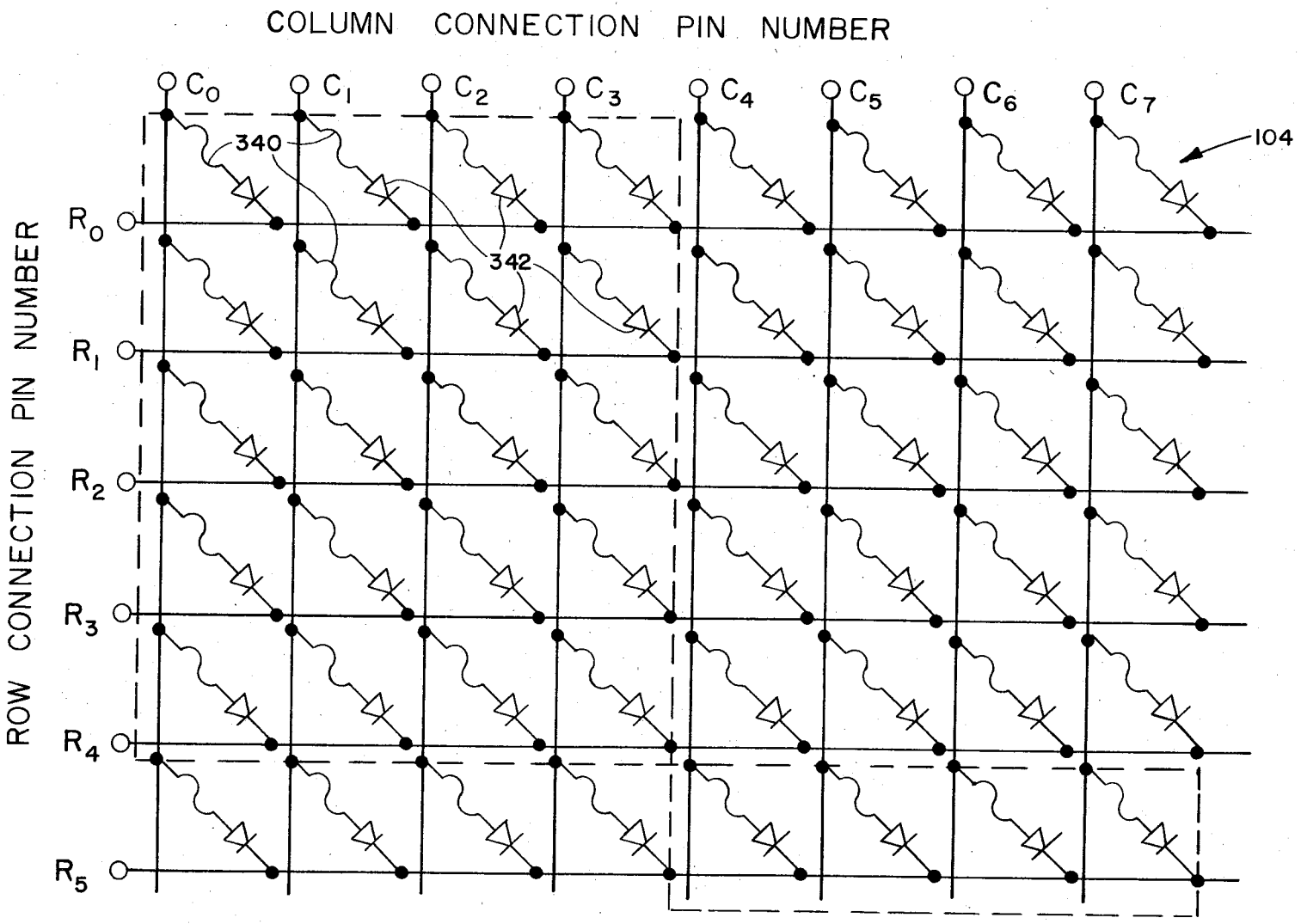

These and other objects and advantages of the present invention will become apparent after considering the following detailed specification which discloses and describes a preferred embodiment of the present invention in conjunction with the accompanying drawings, wherein:

FIGS. 1A and 1B together are a schematic circuit diagram of a management information system and an associated vend control device constructed according to the present invention; and FIG. 2 is a schematic circuit diagram of a programmable diode matrix circuit adapted to be constructed as part of the system of FIGS. 1A and 1B.

Referring to the drawings more particularly by reference numbers, number 10 in FIGS. 1A and 1B refers to the control circuit of a management information system and associated vend control device constructed according to the present construction. Portions of the circuit are enclosed by dotted lines to identify those circuit portions which perform specific functions in the system. The more important outlined circuit portions include:

Circuit portion 12 which includes transmit and receive circuits associated with a microprocessor in the management information system portion of the present device;

Circuit portion 14 includes circuits which are used for vend payback motor control;

Circuit portion 16 includes a diode matrix and associated price selection circuitry;

Circuit portion 18 includes the memory circuits of the present device used to store accumulated information about the various vending machine operations;

Circuit portion 20 includes the circuits for the power supply, power supply back up, power failure detector means, the reset and related circuits for the subject device; and Circuit portion 22 includes the circuitry associated with the door switch on a vending machine.

The structural and operational details of the circuits included in the circuit portions 12–22 will be described individually in greater detail hereinafter.

The circuit portion 12 has connection means 24 and 26 on which information and data transmissions are received. This portion of the circuit includes coil 28 which is connected between the connections 24 and 26 and can be coupled to a similar coil 29 associated with some external source such as a portable interrogator device 27. The portable interrogator device 27 may be coupled to and programmed by a computer and associated software (not shown) and is used to make changes in certain parameters in the subject circuits including changes in the management information circuits as well as in the circuits that control the vending machine. The portable device 27 may also include means to receive and retain information about the vending machine for later transfer to and entry in the computer or like device. In the receive mode of operation serial positive going pulses from the interrogator device 27 raise the potential on emitter 30 of normally unbiased transistor 32, thereby turning the transistor 32, shown as an NPN transistor, off. The collector 34 of the transistor 32 is pulled to a high condition by a positive voltage applied through resistor 36 connected as shown, and this high remains for the duration of the incoming pulses. The same pulse is inverted through NOR gate 38, thereby interrupting microprocessor 40 which subsequently services the incoming management information request by transferring data, in serial pulse form, from its output terminal 42. These pulses occur as negative going pulses and are applied through biasing resistor 43 to base element 44 of another transistor 46 which is turned on by these pulses causing its collector 48 to go high. When this happens current flows through resistors 50 and 52 to the coil 28 which then pulses the interrogator circuit inductively coupled thereto as aforesaid.

The vend payback motor control circuit portion 14 is used to control the paying back of change to a customer which occurs when an over deposit has been made and when an escrow or deposit refund is needed. When an adequate amount of credit has been established by the microprocessor 40, microprocessor pin 56 goes low for a predetermined time period, typically for about 220 milliseconds. This low output is applied to the input of inverter 58 which is gated by a low present on pin 60 of the microprocessor. This causes the low on the input of the inverter 58 to be inverted and to be applied as a high to the input of another inverter 62 which produces a second inversion and applies its low output to one side of relay coil 64 which has its opposite side connected to a positive voltage at 66. When the relay coil 64 is energized its movable relay contact 68 moves from a position engaging stationary contact 70 to a position engaging stationary contact 72. The effect is to interrupt the circuit between lead 74 (L1) and lead 76, which connection depends for continuity on the movable contact 68 being engaged with the contact 70. This operation also establishes continuity between the L1 lead 74 and L3 lead 78. Thereafter, when a vend cycle that has been initiated is completed under conditions when an over-deposit was made so that change is due to be paid back to the customer, another microprocessor terminal 80 will go low. This low is applied to the input of inverter 82 and the high output therefrom is applied to parallel connected inverters 84 and 86. The low on the microprocessor terminal 80 will persist until a carry signal on carry switch 88 associates with payback motor 90 is detected. The output side of the inverters 84 and 86 are connected to motor drive lead 92 and through capacitor 94 to another motor lead 96 which is also connected to a positive voltage source. The microprocessor 40 now waits until payback lead 78 connected to relay contact 72 changes state again, and at that time subtracts one nickel (assuming payback units are in nickels) from the change owed to the customer.

The vend payback motor control circuit 14 also has a zener diode 100 which is connected between the L1 lead 74 and output leads 102 labeled L2. The purpose of the zener diode 100 is to absorb voltage spikes which otherwise might adversely effect the operation.

The diode matrix and price selection circuits 16 include a pre-programmed diode matrix chip 104 which is shown in greater detail in FIG. 2. The matrix 104 is shown organized as a $6\times8$ diode array with the diodes arranged in rows and columns to be programmed in ascending binary fashion. In the embodiment as shown the serialized area is defined by those rows identified as rows $R_0$–$R_4$ and by those columns identifed as columns $C_0$–$C_3$. The matrix 104 also includes other diodes shown connected in similar rows and columns including a sixth row of diodes $R_5$ located below the other rows and additional columns of diodes $C_4$–$C_7$ to the right of the columns $C_0$–$C_3$. The additional columns are used to address price selection switches. During operation the diode matrix 104 is accessed by addressing one row at a time, and as each row is addressed it goes to a low condition. Corresponding signals are read off the columns by the microprocessor 40 at connection terminals 106, 108, 110, and 112 which are connected respectively to associated inverters 114, 116, 118, and 120. These inverters have their opposite sides or inputs connected to respective terminals 122, 124, 126, and 128 of the matrix 104. The serial number produced at these connections is used to identify a particular location in the changer circuit associated with the subject device, and is encoded by the management information system (MIS). The details as to the operation of the diode matrix 104 will become more apparent hereinafter.

The battery backed up memory circuit 18 includes a random access memory (RAM) 130 shown having a $256\times4$ bit capacity, and the circuit portion 18 also includes an address RAM latch portion 132. The memory RAM 130 and the latch RAM 132 are connected to the microprocessor 40 and to other circuit portions and are multiplexed between address read and address write modes by various strobes including strobe 134 labeled ALE, strobe 136 labeled $\overline{WR}$ and strobe 138 labeled $\overline{RD}$. In the construction as shown the first 6 bits which appear on bus mode of leads 140–150 are used to address the latch RAM 132 but only the first 4 bits are either written into or read from the RAM 130 on the first four bus leads 140–146. The memory functions of the RAM 130 are enabled by the operation of OR gates 152, 154, and 156 which gates respond to outputs of the microprocessor 40 appearing on terminal 158 labled $PI_6$ or by reset outputs from reset circuit element 160 on terminals 162, 164, and 166 labeled respectively $EN_2$, $Q3_1$, and $CL_1$. The operation and functions of the memory RAM 130 and the latch RAM 132 will be described more fully hereinafter.

The circuit portion 20 includes the power supply, power/fail detector circuitry, the reset circuitry, part of which has already been described, and the battery circuits. The incoming circuit power, typically 12 volts AC, may be from the output side of a step down transformer (not shown) and is applied to an input power circuit 168 which has its positive output applied through diode 170 to the input of a voltage regulator 172. The voltage regulator 172 is also connected to a filter circuit formed by grounded parallel capacitors 174 and 176 and through another diode 178 and a resisitor 180 to the base of transistor 182. The transistor 182 has its collector 184 connected to the R or reset terminal of the voltage regulator 172, and the emitter 186 of the transistor 182 is connected to a circuit which includes a battery 188 in series with resistor 190 across grounded capacitor 192. The transistor 182 is used to trickle charge the battery 188 to assure that the battery will always have sufficient charge to prevent the loss of certain data stored in the circuit in case of a power failure or interruption such as due to the plug being pulled out of the wall or other failure of the power to or from the power source. In case of a power failure or power interruption the battery 188 will always have enough charge on it to prevent the circuit from losing information stored in it including information concerning the vending machine and its operations. The reset R terminal of the voltage regulator circuit 172 is connected to another grounded filter circuit which includes capacitors 194 and 196 connected as shown.

The unregulated power supply, which is shown as 18 volts DC, is monitored by a circuit which includes another transistor 198 which has its collector 200 connected through resistor 202 to reset input 204 of the reset chip 160. When a power failure occurs the transistor 198 signals the reset chip 160 of the condition by a signal on the collector 200, and this in turn produces an output on the reset chip 160 which is applied to reset input terminal 206 of the microprocessor 40 causing the microprocessor 40 to go into a reset condition. This is done to prevent the loss of information should a power failure occur as will be explained more fully hereinafter.

Another transistor 208 is connected to the DC output of the full wave recified AC input present on the output of the power circuit 168. The collector 210 on the transistor 208 is connected through resistor 212 to microprocessor input terminal 214, labeled T1. A signal will be present at the terminal 214 even before a signal is present on the reset microprocessor input 206 to give the microprocessor 40 advanced warning that a power failure is about to occur. The transistor 208 has resistors and capacitors connected to its various elements as shown to establish an operating condition therefor. The resistors include resistors 216, 218, 220, 222 and 224 and the capacitors include capacitors 226 and 228 all connected as shown. Thus, with the present circuit, the microprocessor 40 will receive advanced warning of a power failure and shortly thereafter it will receive a reset signal. The time period between the receipt of these signals is sufficient for the microprocessor 40 to respond to prevent the loss of information already stored in the circuit.

A Schmitt trigger 230, connected to capacitor 232 and resistor 234 as shown, is connected to input terminals 236 and 238 of the reset chip 160. The Schmitt trigger 230 operates as an oscillator which runs at a frequency typically about 1 K Hz. In a typical situation more than 15 pulses from the Schmitt trigger 230 will be counted into the reset chip 160 before a reset pulse is received from the terminal 274 for applying at terminal 240 labeled $R_2$, at which time the microprocessor 40 will be temporarily reset bringing it back to some known state. If a reset occurs for any reason, the memory RAM 130 will be disabled through one or more of the OR gates 152, 154, and 156 to prevent the loss of information which may be stored therein. The output of the OR gate 156 is connected through resistor 242 to the $R_2$ reset input 240 of the reset chip 160. The reset chip 160 also has other connections including a power connection at terminal 244, labeled $V_{DD}$, and another power connection through capacitor 246 at terminal 248, labeled $V_{SS}$. Another connection is made between terminal 250, labeled $Q4_2$, and terminal 204, labeled $R_1$, by way of a diode 252. A capacitor 254 is also connected between the reset input 240 of the reset chip 160 and the terminal 274 on the microprocessor 40.

The circuit portion 22 is associated with the door switch on a vending or like machine, and includes connection 256 to grounded normally closed door switch 257. The door switch circuit 22 also has a positive voltage connection through resistor 258 connected to microprocessor input terminal 262, labeled T and also across grounded capacitor 260. The microprocessor 40 uses the impulses it receives from the door switch circuit 22 to distinguish between free vends that occur when the door is open as when the machine is being serviced and/or tested and vends that are made to customers. The door switch circuit 22 enables the introduction of a security access code that is used to distinguish between different kinds of vends, and this distinction is important for management information and interrogation purposes.

In the circuit of FIGS. 1A and 1B are shown other connections to and from the microprocessor 40 including circuit connection 266 identified as $P1_4$ and circuit connection 268 identified as $P1_5$. These connections are made respectively to and through coin switch 270 to ground, and to and through a normally open machine tilt sensing element 272. The microprocessor 40 also has a connection 274 to one side of the capacitor 254 described above in connection with the reset circuit 160.

Other microprocessor terminals include terminal $P2_0$ on lead 276 identified as the payback control lead, terminal $P2_1$ on lead 278 identified as the 25¢ lead in the payback circuit used to control the paying back of quarter coins, terminal $P2_2$ on lead 280 identified as the 10¢ payback lead used for controlling the paying back of dime coins, and terminal $P2_3$ on lead 282 which is used to control the paying back of nickel coins and is identified as the 5¢ payback lead. Microprocessor terminals 284 and 286 are connected to a crystal controlled oscillator circuit which includes crystal element 288 and grounded capacitors 290 and 292 connected as shown. This circuit is included for timing and control purposes in the microprocessor 40. Microprocessor terminals 294, 296, 298, and 300 and associated capacitors 302 and 304 are used by the microprocessor for internal control purposes. The circuit also includes groups of unnumbered biasing resistors which are connected to various points in the circuit to establish operating conditions therefor but are not part of the present invention as such.

There are also circuit connections between the RAM 130 and the latch RAM 132 as well as connections between the microprocessor 40 and the matrix 104. These connections include the eight leads shown connected between the upper side edges of the elements 130 and 132, the connection labeled ALE at terminal 134 of the microprocessor, the input terminal 306 to the latch element 132, terminal 136, labeled $\overline{WR}$, connected to input terminal 308 of the RAM 130, and terminal 138, labeled $\overline{RD}$, which is connected to input terminal 310 of the RAM 130. The RAM 130 also has operating control connections on leads 312 and 314 which are connected across grounded capacitors 316 and 318 and used for timing control purposes. Microprocessor bus terminals 140–150 as well as the previously mentioned terminals 106, 108, 110, and 112 are connected to the diode matrix 104 as shown. The diode matrix 104 has other connections between its input terminals 122, 124, 126, and 128 and other respective inputs thereto, namely inputs 320, 322, 324, and 326 and these are made through respective vend pricing switches 328, 330, 332, and 334 which are used to establish the vend price for the vending machine.

As explained above the subject circuit represents a unique approach to the handling and management of information produced by vending control devices such as in vend changer devices, and the subject management information system is designed and constructed to operate and to be housed in the same housing structure as the coin changer mechanism it is associated with without increasing the size or shape thereof or the number of connections between the changer and the vending machine controlled thereby. This is an important practical advantage of the subject system and enables combining the information management functions with the vending functions in the same space. Also, the present device is the first known device that uses pre-programmed encoded serialization of information in this type of an application, and it includes coin-jam detection means which time-out the payback motor each time it is operated and readies the changer for future vends. The present system is adapted to retrofit with existing coin changers such as those disclosed in U.S. Pat. Nos. 3,841,456 and 3,894,220 and to do so without requiring any additional wiring to or from the vending machine to support the management information system operations and functions.

FIG. 2 shows the details of the construction of the diode matrix 104. The matrix includes a plurality of similar circuit elements such as resistors 340 and diodes 342 connected and arranged in rows and columns. In the construction as shown there are provisions for six rows of elements labeled rows R0–R5 and eight columns of elements labeled columns C0–C7. The region of the matrix defined by rows R0-R4 and columns C0–C3 are programmed in a serial binary fashion from left to right with R0, C0 representing the least significant bit, and R4, C3 representing the most significant bit. A binary 0 is achieved with a disconnected diode and a binary 1 is achieved by leaving the appropriate diode intact. In a typical situation certain of the diodes are to be disconnected such, for example, as the diodes in rows R0–R4 and columns C4–C7, and the diodes in row R5, columns C0–C3.

The present device, as explained above is designed to be retrofitted with an existing changer in a vending machine to provide an increased number of operating characteristics and to provide the management information functions required by the system. The present combined changer/management information system, as indicated, can be fitted into the same space required for an existing changer by itself, and when this is done the system will perform all of the functions necessary for the changer as well as the added functions of the management information system. The present means therefore provide a way to expand the number of functions that a changer will perform and in a package which also includes the functions of a management information system as described above. The management information functions include the functions of gathering and retaining information as to number of free vends, as when the vending machine door is open, as to net sales, number of items sold, coin jam detection information which times-out the payback motor and readies the changer for future vends, it retrofits to existing series changers without requiring any additional machine wiring to support the management information system functions, it provides storage for the data accumulated by the system and it provides backup battery protection for the management information system and the information accumulated thereby to prevent the loss of stored data due to a power interruption or failure. The present management information system operates under control of a microprocessor to store and record information as to price, cash accrued, number of sales, number of free vends, number of vends made with the vending machine door open, time and frequency of service and other information. The device also includes the interrogation coil 28 which may be mounted at a suitable location such as on the front of the coin changer in which case the system may not require monitoring the door switch for free vends. The interrogation coil can also be mounted externally of the changer at some suitable location which permits interrogation of the vending machine while the door is closed in which case the device permits the monitoring of free vends under control of the door switch. The present device also has coin-jam time-out means with a predetermined time limit, such as a three second time limit, for each coin to be paid back as change. For example, if three nickels are to be paid back nine seconds will have to have elapsed before the coin changer will be able to again permit accepting coins and vending products.

Thus there has been shown and described a novel control circuit for a vending machine which includes and combines vending, payback and escrow features, storage means to store information as to the operation of the vending machine, and protection against power failure all of which fulfill all of the objects and advantages sought therefor. It will be apparent to those skilled in the art, however, that many changes, modifications, variations, and other uses and applications for the present device are possible and contemplated, and all such changes, modifications, variations, and other uses and applications which do not depart from the spirit and scope of the invention are deemed to be covered by the invention which is limited only by the claims which follow.

What is claimed is:

1. In combination a vend circuit for a vending machine and means to accumulate an ongoing history of the operation of the vending machine including an ongoing history of sales, service, and machine down time, the vend circuit having switch means operable to distinguish between when the vending machine door is open and the vending machine is being services and when the vending machine door is closed comprising a vending control circuit including:

means to respond to the deposit of credit in the vend machine including means to accumulate a total thereof taking into account vending, paying back or refunding operations, means to cause a vend to take place when the amount deposited at least equals the price of a selected vend, means including a diode matrix circuit having diodes arranged in rows and columns and having first and second portions, switch means operatively connected to the first portion of the diode matrix for establishing therewith a vend price for the vending machine;

other circuit means operatively connected to the second portion of the diode matrix for addressing the second portion thereof;

means to payback any excess deposited over the cost of the selected vends, means including programable memory means operatively connected to the vend control circuit to accummulate an ongoing history of the operation of the vending machine including;

means responsive to the means to accumulate a total of the deposit of credit to keep a running accumulation of net sales from the vending machine, means responisve to the means operable to distinguish between when the vending machine is being serviced including means to keep a record thereof, means responsive to the condition of the door switch means on the vending machine to distinguish whether the door to the vending machine is open or closed to produce changes in the control circuit which enable the vend control circuit to distinguish between vend operations made when the door is open and when it is closed, and means to prevent the loss of accumulated information under conditions when there is an interruption in power to the vend control circuit, said means including a main source of power for operating the vending machine, an internal source of power including means operatively connecting the main source of power to the internal source to maintain a charge thereon during operation of the vending machine by the main source of power and timer means, first means responsive to an interruption in power from the main power source including means to disable the programmable memory means and to initiate the timer means to produce a timer interval of predetermined duration, and second means for resetting the vend control circuit at the conclusion of the time interval.

2. In the combination of claim 1 the vend control circuit includes a microprocessor for controlling the circuit operations, said first means responsive to an interruption in power from the main power source including means operatively connected to said means to accumulate an ongoing history of the operation of the vending machine to prevent said means from losing information accumulated therein when a power interruption occurs and thereafter applying a reset signal to the microprocessor.

3. In the combination of claim 1 the vend control circuit includes a microprocessor and said first means responsive to an interruption of power from the main power source is operatively connected to the means to accumulate an on-going history and operates to prevent the loss of data stored therein prior to the time that the microprocessor is reset due to the power interruption.

4. In a control circuit for a vending machine having means to receive, enter and accumulate deposits of credit, means to produce a vend operation when the amount of credit deposited at least equals the price of a selected vend, means to refund amounts deposited in excess of the cost of a selected vend, the vending machine having a door which is opened when the machine is to be restocked and serviced and door switch means having a first condition when the door is open and a different condition when the door is closed, the improvement comprising means responsive to the deposit of credit entered into the vending machine to accumulate a running total of amounts of credit entered in the vending machine over a period of time, means responisve to each amount refunded to reduce the running total accumulated by the means to accumulate by amounts paid back, circuit means responisve to the condition of the door switch means including means distinguishing between vends made when the door is open and when the door is closed, means responsive to each vend operations to keep a running total of the number of vend operations that take place including vend operations performed when the vending machine door is closed and vend operations performed when the vending machine door is open, means for storing the running totals of amounts of credit entered and the number of vend operations that take place, means for connecting the control circuit to an external power supply for supplying power to operate the control circuit and internal changeable power supply included in the control circuit operatively connected to the external power supply, said internal power supply including means to charge the internal power supply with energy from the external power supply to maintain a charge therein, means responisve to an interruption in the supply of power from the external power supply including means to disable the means for storing running totals to prevent changes from occuring therein, and other means in the control circuit operable when there is an interruption in the supply of power from the external power supply to delay resetting the control circuit for a predetermined time interval.

5. In the control circuit of claim 4 the means to accumulate a running total of amounts of credit entered and the means to keep a runing total of the number of vend operations that take place including a non-volatile electrically alterable memory means.

6. In the control circuit of claim 4 further including a microprocessor having operative connections to the internal and to the external power supplies and to the means to accumulate running totals of amounts of credit entered.

7. In the control circuit of claim 6 further comprising a matrix circuit formed electrically by rows and columns of unidirectional current flow devices, means operatively connecting the matrix circuit to the microprocessor, and other means for connecting the matrix circuit to the means for accumulating running totals of credit entered.

8. In the control circuit of claim 7 further comprising means connected to the matrix circuit and operable to establish the vend price of the vending machine.

9. In the control circuit of claim 6, the means to refund amounts deposited in excess of the cost of a selected vend operative in association with the microprocessor to establish a predetermined time interval within which each amount to be refunded is to take place, said refund means including means associated with the microprocessor to prevent the further accumulation of deposits and to prevent further vend operations when the predetermined time has lapsed and the refund operation is not completed.

10. In the control circuit of claim 4 further including external control means and means for electromagnetically coupling the control circuit to the external control means for the exchange of information, instructions and data therebetween.

11. Means to prevent loss of information stored in a control circuit due to a power interruption comprising a control circuit having an input operatively connected to a source of information, means to process information received from the source including a microprocessor having input and output control and data connections, a power input connection and a reset input connection, an electronic storage device operatively connected to the microprocessor for storing and accumulating selected information processed by the control circuit, a source of energy operatively connected to the control circuit for operating the control circuit including a source of unregulated power, a rechargeable power source operatively connected to the control circuit and to the source of energy and means including the source of energy to maintain a charge on the rechargeable power source, means to detect the occurrence of an interruption of power from the source of energy including means to produce a signal in response thereto, means to apply the signal produced by the detection means to a selected one of the microprocessor control input connections to give the microprocessor notice of the occurrence of the power interruption, timer means responsive to the signal produced by the detection means to initiate a predetermined time period, said timer means causing a signal to be applied to the microprocessor reset input connection to reset the microprocessor at the conclusion of the predetermined time period, means operatively connecting the microprocessor to the electronic storage device, and other means to disable the storage device when a power interruption is detected to prevent the loss of information stored therein between the time a power interruption is detected by the detecting means and the time the microprocessor is later reset.

12. The means of claim 11 further including a reset circuit having an input connected to respond to the signals produced by the detecting means, a first output operatively connected to the reset input connection of the microprocessor and a second output operatively connected to the electronic storage device.

13. The means of claim 12 further including an oscillator circuit operatively connected to the reset circuit, the frequency of the oscillator circuit being greater than the time difference between the time when a signal produced by the detecting means is applied to the control input to the microprocessor and the time when a reset input is applied to the reset input connection of the microprocessor.

14. The means of claim 13 wherein the oscillator circuit includes a Schmitt trigger.

15. The means of claim 11 wherein the electronic storage device includes a random access memory device.

16. The means of claim 11 wherein the electronic storage device includes a latch type random access memory device.

17. The means of claim 11 further including means to supply power to the control circuit from the rechargeable power source when an interruption in the supply of power from the source of energy is detected.

18. In combination a vend control circuit for a vending machine and a circuit for accumulating and storing for later transfer accumulated information about the ongoing operation of the vending machine, the vending machine having a door that can be opened to restock and service the machine, the vend control circuit comprising means responsive to the deposit of credit into the vending machine to enter the amounts of credit, means to cause a vend operation to occur whenever the amount of credit entered at least equals the price of a selected vend, means to refund to the customer amounts of credit entered in excess of the price of a selected vend, and means including door switch means on the vending machine responisve to the condition of the machine door to distinguish between free vends made when the vending machine door is open and customer vends made when the vending machine door is closed, the circuit for accumulating and storing information including random access memory means operatively connected to the vend control circuit, and means for operatively coupling to the circuit for accumulating and storing information including microprocessor means and matrix circuit means operatively connected thereto to control the reading out from the circuit for storing information information stored therein, said matrix circuit means including a plurality of diodes arranged in a plurality of rows and columns, a selected first group of diodes in the matrix circuit means being used for addressing purposes and a selected second group of diodes being used for pricing purposes.

19. The combination of claim 18 further including control means operatively connected to the circuit for accumulating and storing information, said control means including means responsive to the occurrence of a power interruption to disable the circuit for accumulating and storing and to initiate a timing operation at the conclusion of which the microprocessor is reset to prevent the loss of information stored therein in the event of a power interruption.

20. The combination of claim 18 wherein the circuit for accumulating and storing information includes a random access memory device and a latch type random access memory device.

21. A vend control circuit for a vending machine comprising means to accept and accumulate credits deposited in the vending machine, means responsive to the amount accumulated in the means to accept and accumulate to initiate a vend operation whenever the amount of credit accumulated at least equals the price of a selected vend, means responisve to the acceptance and accumulation of credit in excess of the vend price to refund the excess amounts of credit accumulated, and means to establish a selected vending machine identification indicia and a vend price for the vending machine including a diode matrix circuit having a plurality of diode devices organized electrically in rows and columns, a first group of which are reserved for entering a vending machine identification indicia and a second group of which are reserved for entering the vend price, first means including microprocessor means operatively connected to the diodes of the first group to establish the identification indicia therein, and second means including a group of switches operatively connected to the diodes of the second group to establish the vend price therein, the combined setting of the group of switches establishing the vend price for the machine.

22. The vend control circuit of claim 21 wherein the means to refund includes means for paying back over deposits in coins, said payback means including means to establish the amount to be paid back during each vend operation, means to reduce the amount established for payback by the value of each coin paid back, and means to establish a time period during which each coin is to be paid back, means including means to reduce the amount remaining to be paid back by the value of each coin paid back even if a coin to be paid back is not paid back within the established time period therefor to enable payback of succeeding coins until the amount remaning in the means to establish the amount to be paid back is zero.

23. In combination a vend control circuit for a vending machine and means to accumulate an ongoing history of the operation of the vending machine including ongoing histories of sales, service and machine down time comprising a vend control circuit including means to respond to the deposite of credit in the vending machine, means responsive to the deposit of credit at least equal to the vend price to cause a vend to take place, means in the control circuit to establish the vend price of articles to be vended including a matrix circuit formed by rows and columns of diodes, a first group of the diodes being used for establishing a vend price, and a second different group of the diodes being used for address purposes, means to control the entry of pricing information into the first portion of the matrix, and means to payback the excess of amounts deposited over the vend price, said means to accumulate an ongoing history of the operation of the vend machine including means to keep a running accumulation of amounts of credit deposited in the vending machine, means to reduce the running accumulation by the amount of each payback, means to distinguish between times when the vending machine is in operation and times when the vending machine is being serviced including circuit means responsive to times when the vending is serviced to make a record thereof, said means to distinguish between times when the vending machine is in operation and when it is being serviced including switch means responsive to whether the door to the vending machine is open or closed, means to store information as to sales of the vending machine when the door is closed and information as to machine service when the door is open, a main source of power for operating the control circuit and an internal source of power which is part of the control circuit and is charged by the main source of power whenever the main source of power is supplying power to operate the circuit, means to prevent the loss of the stored information under conditions when there is an interruption in power from the main source of power to the control circuit including means responsive to an interruption in the power from the main power source to establish a circuit condition to disable the means to store information, said means to prevent a loss of stored information including means to delay resetting the vend control circuit for a predetermined time interval after disabling the means to store information.

* * * * *

UNITED STATES PATENT OFFICE

CERTIFICATE OF CORRECTION

Patent No. 4,598,378 Dated July 1, 1986

Inventor(s) Harlan R. Giacomo

It is certified that error appears in the above-identified patent and that said Letters Patent are hereby corrected as shown below:

Column 9, line 29, "responisve" should be ---responsive---.

Column 10, line 18, "responisve" should be ---responsive---.

Column 10, line 38, "changeable" should be ---chargeable---.

Column 10, line 44, "responisve" should be ---responsive---.

Column 12, line 29, "responisve" should be ---responsive---.

Signed and Sealed this

*Sixteenth* Day of *September 1986*

[SEAL]

*Attest:*

DONALD J. QUIGG

*Attesting Officer* *Commissioner of Patents and Trademarks*